US008071017B2

(12) United States Patent
Fedchun et al.

(10) Patent No.: US 8,071,017 B2
(45) Date of Patent: Dec. 6, 2011

(54) LOW COST HIGH STRENGTH MARTENSITIC STAINLESS STEEL

(76) Inventors: Vladimir A. Fedchun, Farmington Hills, MI (US); Gregory Vartanov, Oakville (CA)

( * ) Notice: Subject to any disclaimer, the term of this patent is extended or adjusted under 35 U.S.C. 154(b) by 328 days.

(21) Appl. No.: 12/288,936

(22) Filed: Oct. 25, 2008

(65) Prior Publication Data

US 2009/0196784 A1 Aug. 6, 2009

Related U.S. Application Data

(60) Provisional application No. 61/063,677, filed on Feb. 6, 2008.

(51) Int. Cl.

| | |
|---|---|
| ***C22C 38/20*** | (2006.01) |
| ***C22C 38/22*** | (2006.01) |
| ***C22C 38/40*** | (2006.01) |
| ***C22C 38/44*** | (2006.01) |

(52) U.S. Cl. ..... 420/90; 420/91; 420/60; 420/61; 148/326; 148/335

(58) Field of Classification Search ..... 420/60, 420/61, 90, 91, 104, 105, 108, 109, 115; 148/325, 326, 333–335, 577, 598, 597, 605, 148/607, 663

See application file for complete search history.

(56) References Cited

U.S. PATENT DOCUMENTS

2005/0011589 A1* 1/2005 Ishida et al. ..... 148/307
2005/0103408 A1* 5/2005 Kuehmann et al. ..... 148/608

FOREIGN PATENT DOCUMENTS

JP 2007-277639 A1 * 10/2007

* cited by examiner

*Primary Examiner* — George Wyszomierski
*Assistant Examiner* — Mark L Shevin

(57) ABSTRACT

A cobalt-free low cost high strength martensitic stainless steel, with concentration of Ni up to 3.0% and Mo up to 1.0% of weight, has HRC of 53, UTS of 297 ksi, YS of 220 ksi, Charpy V-notch impact energy of 17.8 ft-lb, corrosion resistance in salt spray test ASTM 117. The steel was melted in an open induction furnace and vacuum arc remelting (VAR) and/or electroslag remelting (ESR) were not used to refine the steel. Further processing included homogenized annealing, hot rolling, and recrystallization annealing. The steel was heat treated by oil quenching, refrigeration, and low tempering. The steel has a microstructure consisting essentially of small packets of fine martensite laths, retained austenite, and carbides as centers of growth of the martensite laths. The cost and energy in making the steel are substantially reduced.

6 Claims, 9 Drawing Sheets

TABLE I

INDUSTRIAL HIGH STRENGTH STAINLESS STEELS

| Type of Steel/ Alloying Element, % wt. | Carpenter 15-5 PH | Carpenter Custom 450 | Carpenter Custom 455 | Carpenter Custom 465 | Ferrium S53 |
|---|---|---|---|---|---|
| C | 0.05 | 0.05 | 0.05 | 0.04 | 0.21 |
| Cr | 12.7 | 14.8 | 11.5 | 12.0 | 10.0 |
| Ni | 8.0 | 6.5 | 8.6 | 11.0 | 5.5 |
| Mo | 2.3 | 0.8 | - | 1.0 | 2.0 |
| Co | - | - | - | - | 14.0 |
| Ti | - | - | 1.3 | 1.7 | - |
| Al | 1.2 | - | - | - | - |
| Cb (Nb) | - | 0.6 | 0.3 | - | - |
| Fe | remainder | remainder | remainder | remainder | remainder |

TABLE I

INDUSTRIAL HIGH STRENGTH STAINLESS STEELS

| Type of Steel/ Alloying Element, % wt. | Carpenter 15-5 PH | Carpenter Custom 450 | Carpenter Custom 455 | Carpenter Custom 465 | Ferrium S53 |
|---|---|---|---|---|---|
| C | 0.05 | 0.05 | 0.05 | 0.04 | 0.21 |
| Cr | 12.7 | 14.8 | 11.5 | 12.0 | 10.0 |
| Ni | 8.0 | 6.5 | 8.6 | 11.0 | 5.5 |
| Mo | 2.3 | 0.8 | - | 1.0 | 2.0 |
| Co | - | - | - | - | 14.0 |
| Ti | - | - | 1.3 | 1.7 | - |
| Al | 1.2 | - | - | - | - |
| Cb (Nb) | - | 0.6 | 0.3 | - | - |
| Fe | remainder | remainder | remainder | remainder | remainder |

FIG.1

TABLE II

MECHANICAL PERFORMANCE of

INDUSTRIAL HIGH STRENGTH STAINLESS STEELS

| Type/ Mechanical Performance | Carpenter 15-5 PH | Carpenter Custom 450 | Carpenter Custom 455 | Carpenter Custom 465 | Ferrium S53 |
|---|---|---|---|---|---|
| Ultimate Tensile Strength (ksi) | 215 | 196 | 235 | 254 | 288 |
| Yield Strength (ksi) | 205 | 188 | 225 | 239 | 226 |
| Fracture Toughness K1c (ksi x √in) | 115 | 71 | 70 | 89 | 65 |
| Charpy V-notch Impact Energy (ft-lb) | 40 | 40 | 14 | 16 | 17 |

FIG. 2

TABLE III

COMPOSITION of NEW STAINLESS STEEL

| Alloying Element | Steel A concentration, % wt. about | Steel B concentration, % wt. about |
|---|---|---|
| C | 0.3 to 0.65 | 0.3 to 0.65 |
| Cr | 7.5 to 12.5 | 12.5 to 18.0 |
| Mo | 0.1 to 1.0 | at most 0.1 |
| Ni | 1.0 to 3.0 | at most 1.0 |
| Mn | 0.3 to 1.5 | 0.3 to 1.5 |
| (Si + Sn + Ge) | 0.1 to 1.5 | 0.1 to 1.5 |
| and Ge | at most 0.1 | at most 0.1 |
| Cu | 0.3 to 1.3 | 0.3 to 1.3 |
| and Cu | less than (Si+Sn+Ge) | less than (Si+Sn+Ge) |
| (V + Ti + Nb) | 0.15 to 1.25 | 0.15 to 1.25 |
| Al | at most 0.25 | at most 0.25 |
| Fe | remainder | remainder |

FIG.3

TABLE IV

MECHANICAL PERFORMANCE of NEW STAINLESS STEEL

| Mechanical Properties | Steel A | Steel B |
|---|---|---|
| Rockwell Hardness Scale C | 52- 55 | 52 - 57 |
| Ultimate Tensile Strength (ksi) | 270 - 310 | 270 - 320 |
| Yield Strength (ksi) | 200 - 240 | 200 - 260 |
| Charpy V-notch Impact Energy (ft-lb) | 12 - 22 | 5 - 10 |
| Fracture Toughness K1c (ksi x √in) | more than 40 | 15 - 30 |

FIG. 4

TABLE V
MICROSTRUCTURE
of NEW STAINLESS STEEL
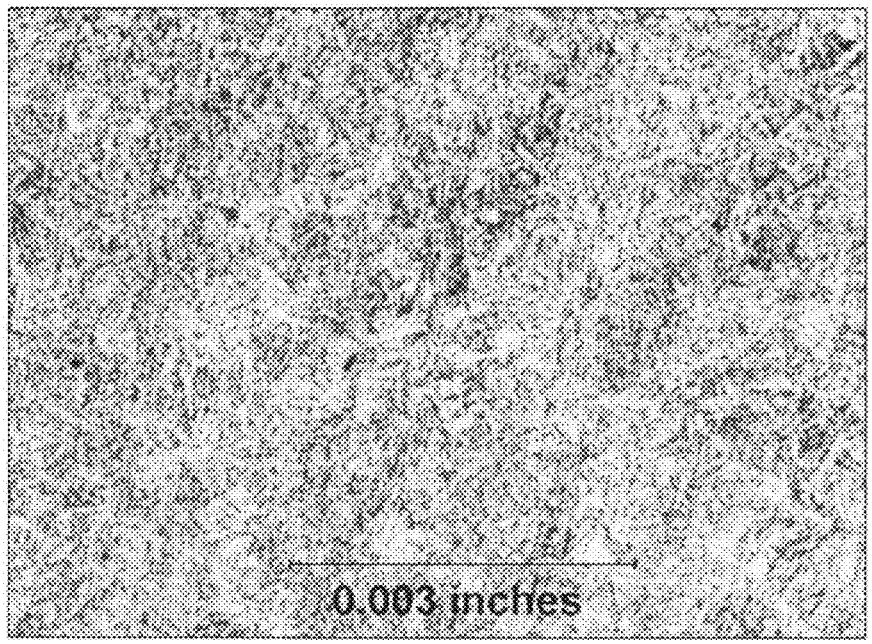
x 750
FIG. 5.1
Example 1 (Steel A)

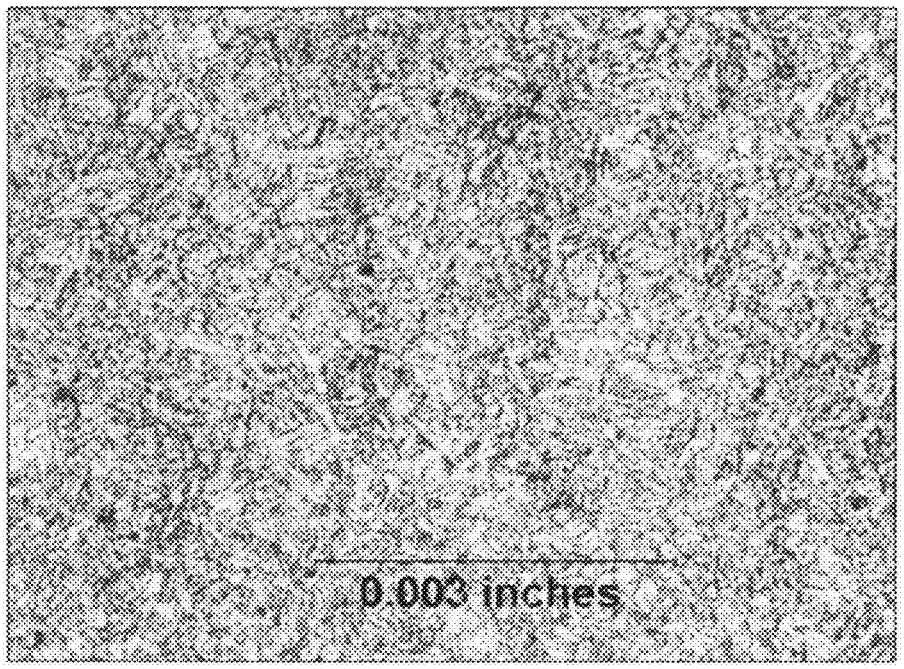
x 750
FIG. 5.2
Example 2 (Steel A)

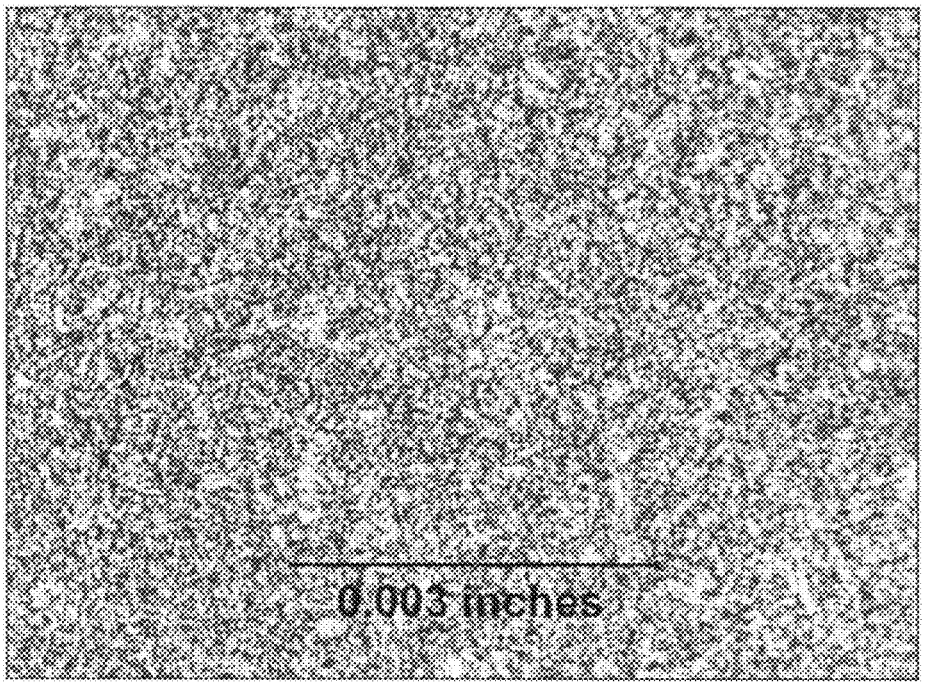
x 750
FIG. 5.3
Example 3 (Steel A with Sn)

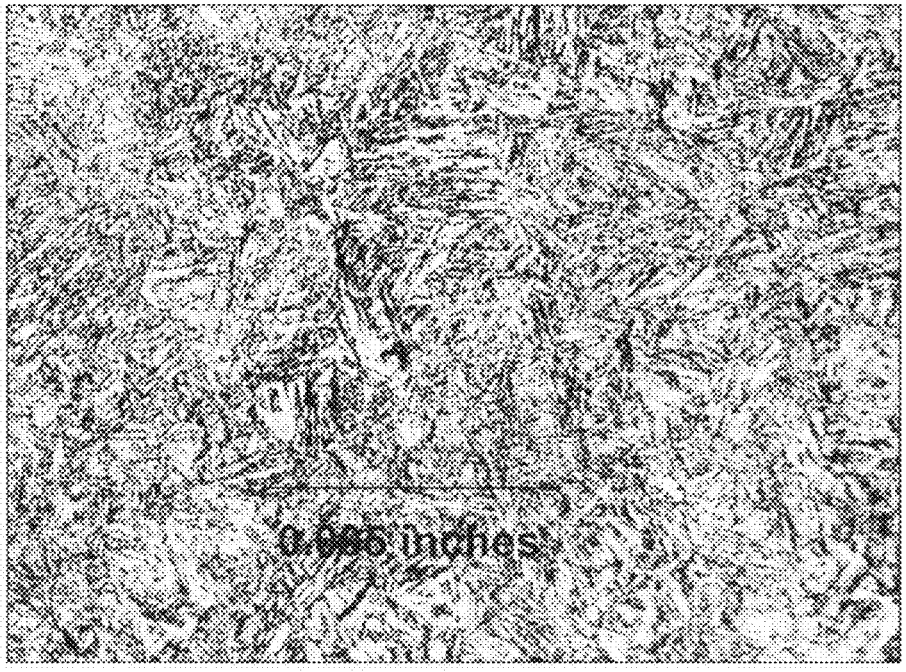
x 350
FIG. 5.4
Example 4 (Steel B)

TABLE VI

COST of CHARGED MATERIALS of

INDUSTRIAL HIGH STRENGTH STAINLESS STEELS and

NEW HIGH STRENGTH STAINLESS STEEL

| | Cost of Charged Materials USD / Mt<br>London Metal Exchange, October 2008 |
|---|---|
| Ferrium S53 | $18,960 |
| Carpenter Custom 465 | $4,790 |
| New Stainless Steel A | $2,650 |
| New Stainless Steel B | $1,690 |

FIG. 6

LOW COST HIGH STRENGTH MARTENSITIC STAINLESS STEEL

RELATED APPLICATIONS

This application claims the benefit of priority of U.S. Provisional Patent Application No. 61/063,677, filed Feb. 6, 2008, which is hereby incorporated by reference in its entirety.

FIELD OF THE INVENTION

This invention relates to a stainless steel and more particularly to a low cost high strength and martensitic stainless steel.

BACKGROUND OF THE INVENTION

Aircraft/aerospace, automotive, and oil/gas structural members are highly stressed components, made of expensive high strength and moderate toughness stainless steels that are used in aggressive corrosive environments. Their high costs are due to large amounts of alloying elements and expensive processing. The availability of some of the alloying elements, by way of example, cobalt (Co) is limited and their use poses future economic and military risks.

The performance of an aircraft/aerospace, etc. stainless steel at room temperature consists of an ultimate tensile strength of 250 to 280 ksi, a yield strength of 200 to 240 ksi, and resistance to corrosion in aggressive environments. As used herein the term "high strength stainless steel" means a high strength steel that has this performance.

Recently introduced Ferrium S53 is exemplary of an expensive high-strength, moderate impact toughness, quench and tempered martensitic, secondary-hardened stainless steel that is used for structural aerospace components. Its high cost is due to 14% by weight of cobalt (Co), 2% by weight of molybdenum (Mo), and 5.5% by weight of nickel (Ni) and has limited the use of this steel.

Carpenter Custom 465 is another example of an expensive high strength stainless steel with 11% by weight of nickel (Ni) and 1% by weight of molybdenum (Mo). It is a moderate impact toughness martensitic age-hardening (maraging) stainless steel that is used for structural aerospace, military, and oil/gas drilling applications.

Ferrium S53 and Carpenter Custom 465 share the cost shortcomings of costly raw materials and the high energy consuming processes of vacuum arc remelting (VAR) and electroslag remelting (ESR).

SUMMARY OF THE INVENTION

A primary object of the invention is to reduce the cost of alloys that are used for structural aerospace, military, and oil/gas drilling purposes. Another object is to reduce the use of scarce elements that are used in high strength stainless steels. With the foregoing objects in mind, a present invention is high strength martensitic stainless steel that is substantially lower in cost than current steels, such as, Ferrium S53 and Carpenter Custom 465. The low cost high strength martensitic stainless steel that is disclosed herein is an important development in high strength martensitic stainless steels. The reductions in cost (see FIG. 6) and energy with the invention are surprising and unexpected. It also cancels the use of scarce and expensive metal, such as cobalt (Co).

The first embodiment (Steel A) of the present invention is a low cost high strength martensitic stainless steel that is recommended for aerospace/aircraft and military purposes.

Steel A has the following properties at room temperature.

| | |
|---|---|
| Hardness Rockwell | C 52 to 55 |
| Ultimate Tensile Strength | 270 to 310 ksi |
| Yield Strength | 200 to 240 ksi |
| Charpy V-notch Impact Toughness Energy | 12 to 22 ft-lb |
| Fracture Toughness (K1c) | more than 40 ksi √ in |
| Corrosion Resistance | Salt Spray Test ASTM 117 |

The second embodiment (Steel B) of the present invention is a nickel-molybdenum free or low concentration nickel-molybdenum high strength stainless steel with lower fracture toughness and KIC Charpy V-notch impact toughness energy performance than Steel A and is recommended for automotive and oil/gas applications.

Steel B has the following properties at room temperature.

| | |
|---|---|
| Hardness Rockwell | C 52 to 57 |
| Ultimate Tensile Strength | 270 to 320 ksi |
| Yield Strength | 200 to 260 ksi |
| Charpy V-notch Impact Toughness Energy | 5 to 10 ft-lb |
| Fracture Toughness (K1c) | 15 to 30 ksi √ in |
| Corrosion Resistance | Similar to the AISI 440A stainless steel |

The microstructure of the new stainless steel consists essentially of small packets of fine martensite laths, retained austenite located between the martensite laths, and carbides as centers of growth of the martensite laths, wherein boundaries of the packets are free of carbides. The new stainless steel has a ratio of the volume of the retained austenite to the volume of the martensite laths of less than 0.20 for Steel A and less than 0.1 for Steel B.

An optimum microstructure was developed by studying the microstructures, chemical compositions, mechanical properties and processing methods of high strength stainless steels which applicants melted and tested.

A desirable compromise was made between strength, impact and fracture toughness, corrosion resistance, and cost by choosing the ratios between austenite stabilizing, ferrite stabilizing and carbite forming elements, the mode of melting and processing and the mode of heat treating.

As used herein the term of processing procedures, includes homogenized annealing, hot rolling or forging, recrystallization annealing, normalizing and high tempering. Heat treatment procedures consist of quenching, refrigeration, and tempering.

The new stainless steel consists of: carbon (C); ferrite stabilizing chromium (Cr), molybdenum (Mo), aluminum (Al), at least one element selected from the group consisting of silicon (Si), germanium (Ge), and tin (Sn); at least one element selected from the group consisting of strong carbide forming vanadium (V), titanium (Ti), and niobium (Nb); austenite stabilizing nickel (Ni), manganese (Mn), copper (Cu); and the balance essentially iron (Fe), incidental elements and impurities.

The new stainless steel differs from the existing stainless steels by the combination of the following features:

Except for chromium (Cr), a total of alloying elements in Steel A that is less than 9% of the weight of the steel and for the Steel B, except for chromium (Cr) a total of alloying elements that is less than 5% of the weight of the steel An absence cobalt (Co) in the steels A and B; and an absence or very low concentration of nickel (Ni) and molybdenum (Mo) in Steel B An ultimate tensile strength of 270 to 320 ksi and a yield strength of 200 to 260 ksi A Charpy V-notch impact toughness energy of 12 to 22 ft-lb and a fracture toughness (K1c) of more than 40 ksi √in for Steel A A corrosion resistance of Steel A in salt spray test ASTM B117 and a corrosion resistance of Steel B that is similar to the corrosion resistance of AISI 440A steel An elimination of the high energy consumption processes vacuum arc remelting (VAR) and/or electroslag remelting (ESR) to refine the new stainless steel A replacement of the vacuum induction furnace and vacuum arc furnace with an open induction furnace An elimination of normalizing and high tempering from the processing of Steel B An elimination of refrigeration from the heat treatment of Steel B A microstructure with boundaries of packets free of carbides that improves resistance to stress corrosion cracking (SSC)

In employing the teachings of the present invention, a plurality of alternate compositions can be provided to achieve the desired results and capabilities. In this specification, only two compositions are presented for the purpose of disclosing the invention. However, these compositions are intended as examples only and should not be considered as limiting the scope of the invention.

The foregoing features benefits, objects and best mode of practicing the invention and additional benefits and objects will become apparent from the ensuing detailed description of a preferred embodiment and the subject matter in which exclusive property rights are claimed is set forth in the numbered claims which are appended to the detailed description of the preferred embodiment.

BRIEF DESCRIPTION OF THE DRAWINGS

FIG. 1 is a table showing the compositions of five industrial grade high strength martensitic aging (maraging) and martensitic secondary-hardening stainless steels in the prior art.

FIG. 2 is a table showing the performance at room temperature of the five industrial high strength martensitic aging (maraging) and martensitic secondary-hardening stainless steels of FIG. 1.

FIG. 3 is a table showing the composition of the new low cost high strength martensitic stainless steel according to the present invention.

FIG. 4 is a table showing the performance at room temperature of the new low cost high strength martensitic stainless steel of FIG. 3.

FIGS. 5.1 to 5.4 show the microstructures of samples of the new low cost high strength martensitic stainless steel of FIG. 3.

FIG. 6 compares the costs of the charged materials of the industrial steels of FIG. 1 and the new steel of FIG. 3.

DETAILED DESCRIPTION OF THE INVENTION

High strength martensitic secondary-hardening and martensitic aging (maraging) stainless steels are well represented in the art. They are characterized by high amounts of nickel (Ni), cobalt (Co), molybdenum (Mo) and other alloying elements. FIG. 1 shows the chemical compositions of Ferrium S53 and several other high strength martensitic aging (maraging) stainless steels of a leading American steel manufacturer. FIG. 2 shows the mechanical performances of the steels shown in FIG. 1. FIG. 3 shows the chemical composition of a low cost high strength martensitic stainless steel according to the invention. FIG. 4 shows the mechanical performance of the low cost high strength steel of FIG. 3. FIGS. 5.1 to 5.4 show that the microstructure of the new high strength consists essentially of small packets of fine martensite laths, retained austenite, and carbides as centers of growth of the martensite laths.

FIG. 6 compares the cost per metric ton of the charged materials of Ferrium S53 (at least $18,969) and Carpenter Custom 465 (at least $4,790) with the cost per metric ton of the charged materials of the present invention (less than $2,650 for Steel A and less than $1,690 for Steel B). The costs of the charged materials are based on data of the London Metal Exchange (LME), dated October, 2008.

FIGS. 1 through 4 disclose some important differences between current industrial grade high strength steels and the new low cost high strength steel. First, the amounts of alloying elements in the new steel are substantially less than the amounts of the current high strength steels. By way of example, except for Cr, the amount of alloying elements in Ferrium S53 is 23% of the weight of the steel whereas the alloying elements in Steel A are less than 9.0% of the weight and in Steel B are less than 5.0% of the weight.

Another important difference is that the amount of expensive-nickel (Ni) in the Steel A is only up to 3.0% of the weight whereas in Ferrium S53 the amount of nickel (Ni) is 5.5% of the weight. A still further difference is that in Ferrium S53, the scarce, expensive cobalt (Co) is 14.0% of the weight whereas cobalt (Co) is not used in Steel A or Steel B. A still further difference is that up to 1.0% of the weight of Steel A is molybdenum (Mo) and 2.0% of the weight of Ferrium S53.

Referring now to FIGS. 2 and 4, it is noteworthy that despite the reduction of amounts of alloying elements in Steel A and Steel B, the strength and impact toughness of Steel A and Steel B are about equal to the strength and toughness of Ferrium S53.

The optimum balance between strength, impact and fracture toughness, corrosion resistance, and cost was reached by selecting: the ratio of the austenite stabilizing, ferrite stabilizing, and carbide forming elements; melting and processing procedures, and heat treatment.

The new stainless steel (Steel A and Steel B) has the following chemical composition.

A carbon (C) content of 0.30 to 0.65% by weight that supports the forming of carbides of at least an element selected from the group consisting of vanadium (V), titanium (Ti), niobium (Nb) or complex carbides as centers of growth of martensite laths and the forming of a microstructure of packet lath martensite.

A chromium (Cr) content of 7.5 to 12.5% of the weight in the first embodiment (Steel A) and of 12.5 to 18% of the weight in the second embodiment (Steel B) provides corrosion resistance and improves strength, hardness, and temperature resistance.

Molybdenum (Mo) is a strong ferrite stabilizing element. A low % level of Mo. increases hardness, toughness, and improves corrosion resistance. The concentration of molybdenum (Mo) is 0.1 to 1.0% of the weight in the first embodiment (Steel A). and at most 1.0% of the weight in the second embodiment (Steel B).

Nickel (Ni) is an austenite stabilizing element which provides high toughness. However, its concentration is limited in the martensitic structure. The concentration of Ni is 0.1 to 3.0% of the weight in the first embodiment (Steel A) and at most 3.0% of the weight in the second embodiment (Steel B).

Manganese (Mn) is a strong deoxidizing, and austenite stabilizing element. A concentration of Mn above 1.5% wt. with the carbon content of 0.3 to 0.65% wt. promotes the formation of the austenite structure. The preferred concentrations of manganese (Mn) is 0.30 to 1.5% of the weight.

Silicon (Si) strengthens the steel matrix by increasing the bonds between atoms in a solid solution and protects the grain boundaries from the growth of carbides, which decrease the toughness of the new steel. Tin (Sn) has the highest coefficient of interaction with the grain boundaries in the alpha-iron. It enriches grain and phase boundaries and displaces all other elements into grains in the alpha-iron based steel. Tin (Sn) forms a fine dispersed structure and prevents the growth of carbides in grain boundary areas. Germanium (Ge) possesses excellent properties for protecting the grain boundaries but its high cost limits its application, so Si and Sn have greater concentrations. At least one element selected from the group consisting of Si, Sn, and Ge is included in the new steel. The preferred concentrations of (Si+Sn+Ge) is 0.1 to 1.5% by the weight and the preferred concentration of Ge is up to 0.1% of the weight.

Copper (Cu) improves properties such as corrosion resistance, ductility, and machinability. The amount of Cu was determined to be at most 0.3 to 1.3% by weight and the concentration of Cu is less than the concentration of (Si+Sn+Ge).

Vanadium (V) affects the structure and properties of the new steel in several ways. First, by dispersing particles of carbide in austenite that control grain size. Second, by precipitating vanadium based, finely dispersed secondary carbides during tempering. Third, by affecting the kinetic and morphology of the austenite-martensite transformation. Titanium (Ti) is a more active carbide forming element than vanadium (V). It acts in a similar way as vanadium (V). Small concentrations of the strong carbide forming niobium (Nb) do not affect the kinetics of phase transformations. A basic function of niobium carbides is to inhibit austenite grain growth at high temperatures during heating. At least one element selected from the group consisting of V, Ti, and Nb should be part of the new steel. The concentration of (V+Ti+Nb) is 0.15 to 1.25% of the weight.

Aluminum (Al), the most effective element for deoxidizing, and the preferred concentration is up to 0.25% by weight.

The balance is iron (Fe) and incidental impurities.

Small concentrations of phosphorus (P), sulfur (S), incidental elements and impurities do not critically affect the mechanical properties of the new steel. Therefore the high energy consumption vacuum arc remelting (VAR) and electroslag remelting (ESR) is not used. For making the new steel, the ladle refining furnace (LRF) is used for refining and the vacuum de-gas station is used for removing hydrogen (H) and nitrogen (N).

Lab scale ingots of the new steel were produced in a 100 lb open air induction, furnace and cast into cylindrical graphite molds. Liquid metal was poured at 2950 to 3000° F. After air cooling to room temperature, 60 lb ingots were subjected to homogenized annealing at 2100 to 2150° F. for 6 hours. Thereafter, the ingots were heated to 2100 to 2150° F. and rolled to final sizes of approximately 1.5" thick plates and 1" diameter rods. The plates and rods were subjected to recrystallization annealing at 1100 to 1150° F. for 6 hours. For improving the uniform distribution of the alloying elements in the ingots, the homogenized annealing is repeated one or more times. To improve and restore the grain structure after rolling or forging, recrystallization annealing is repeated one or more times.

After recrystalization annealing, some plates and rods were subjected to normalizing at 1900 to 1950° F. for 3 hours and then air cooled to room temperature to eliminate severe texture after rolling.

After normalizing, some plates and rods were subjected to high tempering at 1100 to 1120° F. for 3 hours and then air cooled to room temperature. Additionally, to refine the grain and eliminate severe texture after rolling, normalizing and high tempering is repeated one or more times.

Standard ASTM specimens for tensile and Charpy V-notch impact tests were machined. The machined specimens were subjected to austenizing at 1850 to 1900° F. for 60 min., oil quenched for 2 to 2.5 min., and then air cooled to room temperature. Some specimens were subjected to refrigeration at −120° F. The specimens were subjected to tempering at 340 to 440° F. for 3 to 3.5 hours. The temperatures of the austenizing and tempering can be changed to increase the strength and toughness of the specimens.

The quenching and tempering can be repeated one or more times to improve the microstructure. After the heat treatment, the specimens were subjected to mechanical and corrosion tests. In order to better disclose the invention in detail, the following examples are furnished. It should be understood, however, that these examples are presented merely as illustrations of the invention and that the ingredients therein specified may be varied.

Example 1

Steel A

The specimen was comprised by % weight of: 0.37 of C; 2.56 of Ni; 0.78 of Mn; 1.13 of Si; 0.66 of Cu; 8.30 of Cr; 0.97 of Mo; 0.25 of V; 0.11 of Ti; and the balance essentially Fe and incidental elements.

Machined specimens were subjected to the following heat treatment: austenizing at 1900° F. for 60 min., oil quenched for 2 min., and then air cooled to room temperature; refrigerating at −120° F.; tempering at 350° F. for 3 hours and then tempered at 400° F. for 3 hours.

Tests of the specimens produced the following results at room temperature.

| | |
|---|---|
| Rockwell Hardness | C 53 |
| Ultimate Tensile Strength (UTS) | 290 ksi |
| Yield Strength (YS): | 215 ksi |
| Elongation | 12.1% |
| Reduction of Area | 36.7% |
| Charpy V-notch Impact Energy | 20.2 ft-lb |
| Salt Spray Test ASTM 117 for 400 hours | No significant Red Rust on polished surfaces |

The microstructure of test specimens is shown in FIG. 5.1.

Example 2

Steel A

The specimen was comprised by % weight of: 0.42 of C; 2.56 of Ni; 0.72 of Mn; 1.07 of Si; 0.66 of Cu; 8.31 of Cr; 0.98 of Mo; 0.27 of V; 0.16 of Ti; and the balance essentially Fe and incidental impurities.

Machined specimens were subjected to the following heat treatment: austenizing at 1900° F. for 60 min., oil quenched for 2 min., and then air cooled to room temperature; refrigerating at −120° F.; tempering at 350° F. for 3 hours and then tempered at 400° F. for 3 hours.

Tests of the specimens produced the following results at room temperature.

| | |
|---|---|
| Rockwell Hardness | C 55 |
| Ultimate Tensile Strength (UTS) | 297 ksi |
| Yield Strength (YS): | 220 ksi |
| Elongation | 11.7% |
| Reduction of Area | 34.5% |
| Charpy V-notch Impact Energy | 17.8 ft-lb |
| Salt Spray Test ASTM 117 for 400 hours | No significant Red Rust on polished surfaces |

The microstructure of test specimens is shown in FIG. 5.2.

Example 3

Steel A with Sn

This test was done to determine the effect of tin (Sn) on the new steel.

The new steel was comprised by % weight of: 0.38 of C; 2.60 of Ni; 0.73 of Mn; 0.34 of Si; 8.08 of Cr; 0.99 of Mo; 0.26 of V; 0.16 of Ti; and the balance essentially Fe and incidental elements.

Machined specimens were subjected to the following heat treatment: austenizing at 1850° F. for 60 min., oil quenched for 2 min., and then air cooled to room temperature; tempering at 350° F. for 3 hours.

Tests of the specimens produced the following results at room temperature.

| | |
|---|---|
| Rockwell Hardness | C 53 |
| Ultimate Tensile Strength (UTS) | 284 ksi |
| Yield Strength (YS): | 200 ksi |
| Elongation | 12.0% |
| Reduction of Area | 31.4% |
| Charpy V-notch Impact Energy | 14.0 ft-lb |
| Salt Spray Test ASTM 117 for 400 hours | No significant Red Rust on polished surfaces |

The microstructure of test specimens is shown in FIG. 5.3.

Example 4

Steel B

The new nickel and molybdenum-free steel was comprised by % weight of 0.39 of C; 0.53 of Mn; 0.98 of Si; 0.63 of Cu; 12.39 of Cr; 0.15 of V; 0.08 of Ti; and the balance essentially Fe and incidental elements.

Machined specimens were subjected to the following heat treatment: austenizing at 1900° F. for 60 min., oil quenched for 2 min., and then air cooled to room temperature; tempering at 350° F. for 3 hours and then tempered at about 400° F. for about 3 hours.

Tests of the samples produced the following results at room temperature.

| | |
|---|---|
| Rockwell Hardness | C 53 |
| Ultimate Tensile Strength (UTS) | 290 ksi |
| Yield Strength (YS): | 220 ksi |
| Elongation | 10.0% |
| Reduction of Area | 17.4% |
| Charpy V-notch Impact Energy | 6.8 ft-lb |
| Corrosion Resistance | Similar to the AISI 440A stainless steel |

The microstructure of test specimens is shown in FIG. 5.4.

All samples (Examples 1 through 4) had microstructures consisting essentially of small packets of fine martensite laths, retained austenite, and carbides as centers of growth of the martensite laths.

From the foregoing, it is apparent that our invention is an important development in the art of high strength martensitic stainless steels that are used for aerospace, aircraft, military, automotive and oil/gas purposes. It substantially reduces the cost of high strength stainless steels, energy consumption and expensive materials that are in short supply.

Although, only two embodiments of our invention have been described, it is obvious that after having the benefit of our disclosure, that other embodiments can be derived by making obvious and inconsequential changes such as substitutions, additions and changes without departing from the spirit thereof.

What we claim is new is:

1. A martensitic steel comprising by weight: about 0.3% to 0.65% of C; about 7.5% to 12.5.0% of Cr; about 0.1% to 1.0% of Mo; about 0.1% to 3.0% of Ni; about 0.3% to 1.5% of Mn; at least one element selected from the group consisting of Si, Sn, and Ge wherein (Si+Sn+Ge) is about 0.1% to 1.5% and Ge is at most 0.1%; about 0.3% to 1.3% of Cu wherein Cu is less than (Si+Sn+Ge); V and Ti, wherein (V+Ti) is about 0.15 to 1.25%; at most 0.25% of Al; and a balance of Fe and incidental impurities, the sum of said alloying elements of said steel, except for Cr, being less than 9.0% of the weight, whereby said steel has a Rockwell hardness of about C 51 to 55, an ultimate tensile strength of about 250 to 310 ksi, a yield strength of about 200 to 240 ksi, a Charpy V-notch impact toughness energy of about 12 to 22 ft-lb, and a fracture toughness K1c of more than 40 ksi√in.

2. The martensitic steel recited in claim 1 wherein said steel has a microstructure consisting essentially of packets of martensite laths grown on carbides and retained austenite and said packets are free of carbides, said steel having a ratio of the volume of said retained austenite to the volume of said martensite laths that is less than 0.20.

3. A martensitic steel comprising by weight: about 0.3% to 0.65% of C; about 12.5% to 18.0% of Cr; about 0.1% to 1.0% of Mo; about 0.1% to 3.0% of Ni; about 0.3% to 1.5% of Mn; at least one element selected from the group consisting of Si, Sn, and Ge wherein (Si+Sn+Ge) is about 0.1% to 1.5% and Ge is at most 0.1%; about 0.3% to 1.3% of Cu wherein Cu is less than (Si+Sn+Ge); V and Ti, wherein (V+Ti) is about 0.15 to 1.25%; at most 0.25% of Al; and a balance of Fe and incidental impurities, the sum of said alloying elements, except for Cr, being less than 5.0% of the weight, whereby said steel has a Rockwell hardness of about C 52 to 57, an ultimate tensile strength of about 270 to 320 ksi, a yield strength of about 200 to 260 ksi, a Charpy V-notch impact toughness energy of about 5 to 10 ft-lb, a fracture toughness K1c of about 15 to 30 ksi√in.

4. The martensitic steel recited in claim 3 wherein said steel has a microstructure consisting essentially of packets of martensite laths grown on carbides and retained austenite and said packets are free of carbides, said steel having a ratio of the volume of said retained austenite to the volume of said martensite laths that is less than 0.20.

5. A martensitic steel comprising by weight about 0.3% to 0.65% of C; about 7.5% to 12.5% of Cr; at most about 1.0% of Mo; at most about 3.0% of Ni; about 0.3% to 1.5% of Mn; at least one element selected from the group consisting of Si, Sn, and Ge wherein (Si+Sn+Ge) is about 0.1% to 1.5% and said Ge is at most 0.1%; about 0.3% to 1.3% Cu wherein said Cu is less than (Si+Sn+Ge); at least one element selected from the group consisting of V, Ti, and Nb wherein (V+Ti+Nb) is about 0.15% to 1.25%; at most 0.25% of Al; the sum of said alloying elements, except for said Cr, being less than 9.0% of the weight of said steel, and a balance of Fe and incidental impurities, whereby said steel has a Rockwell hardness of about C51 to 55, an ultimate tensile strength of about 250 to 310 ksi, a yield strength of about 200 to 240 ksi, a Charpy V-notch impact toughness energy of about 12 to 22 ft-lb, and a fracture toughness K1c of more than 40 ksi√in.

6. A martensitic steel comprising by weight about 0.3% to 0.65% of C; about 12.5% to 18.0% of Cr; about 0.3% to 1.5% of Mn; at least one element selected from the group consisting of Si, Sn, and Ge wherein (Si+Sn+Ge) is about 0.1% to 1.5% and said Ge is at most 0.1%; about 0.3% to 1.3% Cu wherein said Cu is less than (Si+Sn+Ge); at least one element selected from the group consisting of V, Ti, and Nb wherein (V+Ti+Nb) is about 0.15% to 1.25%; at most 0.25% of Al; and a balance of Fe and incidental impurities, said steel having a Rockwell hardness of about C52 to 57, an ultimate tensile strength of about 270 to 320 ksi, a yield strength of about 200 to 260 ksi, a Charpy V-notch impact toughness energy of about 5 to 10 ft-lb, and a fracture toughness K1c of about 15 to 30 ksi√in.

* * * * *